US009437920B2

(12) United States Patent
Sano et al.

(10) Patent No.: US 9,437,920 B2
(45) Date of Patent: Sep. 6, 2016

(54) PUSH-BUTTON SWITCH

(71) Applicant: ALPS ELECTRIC CO., LTD., Ota-ku, Tokyo (JP)

(72) Inventors: Takashi Sano, Tokyo (JP); Tetsuya Sago, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 67 days.

(21) Appl. No.: 14/585,445

(22) Filed: Dec. 30, 2014

(65) Prior Publication Data

US 2015/0214606 A1 Jul. 30, 2015

(30) Foreign Application Priority Data

Jan. 29, 2014 (JP) ..... 2014-014555

(51) Int. Cl.

| | |
|---|---|
| ***H01Q 7/06*** | (2006.01) |
| ***H01Q 1/32*** | (2006.01) |
| ***H01Q 1/22*** | (2006.01) |
| ***H01H 13/02*** | (2006.01) |
| ***H01H 13/14*** | (2006.01) |
| ***H01H 3/12*** | (2006.01) |
| ***H01Q 7/08*** | (2006.01) |

(52) U.S. Cl.

CPC ..... *H01Q 1/3233* (2013.01); *H01H 3/12* (2013.01); *H01H 13/023* (2013.01); *H01H 13/14* (2013.01); *H01Q 1/2216* (2013.01); *H01Q 1/3241* (2013.01); *H01Q 7/06* (2013.01); *H01Q 7/08* (2013.01); *H01H 2231/026* (2013.01)

(58) Field of Classification Search

CPC ..... H01Q 1/3241; H01Q 7/06; H01Q 7/08; H01H 3/12; H01H 13/14

See application file for complete search history.

(56) References Cited

U.S. PATENT DOCUMENTS

| | | | | |
|---|---|---|---|---|
| 7,733,283 | B2 * | 6/2010 | Sato | H01Q 7/00 343/713 |
| 8,263,885 | B2 * | 9/2012 | Yamamoto | H01H 13/06 200/302.1 |
| 8,653,390 | B2 * | 2/2014 | Shim | B60R 25/00 123/179.2 |
| 2012/0119965 | A1 | 5/2012 | Deguchi et al. | |

* cited by examiner

*Primary Examiner* — Hoang V Nguyen

(74) *Attorney, Agent, or Firm* — Hunton & Williams LLP

(57) ABSTRACT

A push-button switch includes a wiring board having a first surface on which electronic components are mounted. The push-button switch is used for an immobilizer system and supplies power to a portable device from the first surface side of the wiring board. The push-button switch includes a coil antenna and a conductor pattern. The coil antenna includes a magnetic core and a coil conductor wound around the magnetic core. The coil antenna is attached to a second surface of the wiring board. The conductor pattern is formed in at least one wiring layer so as to surround the coil conductor in plan view. The wiring board has an inner layer including the at least one wiring layer. A direction of current flowing through the coil conductor is the same as a direction of current flowing through the conductor pattern.

4 Claims, 11 Drawing Sheets

PUSH-BUTTON SWITCH

CLAIM OF PRIORITY

This application contains subject matter related to and claims the benefit of Japanese Patent Application No. 2014-014555 filed on Jan. 29, 2014, the entire contents of which is incorporated herein by reference.

BACKGROUND OF THE DISCLOSURE

1. Field of the Disclosure

Embodiments of the present disclosure relate to a push-button switch, and particularly to a push-button switch for engine start which is used in an immobilizer system in a vehicle.

2. Description of the Related Art

In moving vehicles, such as automobiles, of the related art, an engine is started by inserting a key into a key hole and operating the key. Recently, a so-called immobilizer system in which an engine is started without inserting a key into a key hole has been used for convenience. The immobilizer system has a configuration having high security in such a manner that an authentication function for engine start is provided and that, when the authentication is not established between the main body of an automobile and a portable device, the engine does not start. When the authentication is established between the main body of an automobile and a portable device, the engine starts by pressing a push-button switch attached to the vehicle.

Thus, the immobilizer system has a configuration in which an authentication operation is performed through communication between the main body of an automobile and a portable device. If the remaining battery level of the portable device becomes equal to or lower than a predetermined value, communication between the main body of an automobile and the portable device may fail to be performed. To avoid this situation, a push-button switch for engine start includes a transmission/reception antenna as communication means for emergency. The portable device is held close to the switch for engine start, whereby power may be supplied from the transmission/reception antenna to the portable device in a non-contact manner, and the communication may be also performed.

A transmission/reception antenna similar to the transmission/reception antenna used in the above-described push-button switch for engine start is disclosed in U.S. Patent Application Publication No. 2012/0119965. FIG. 11 illustrates the configuration of a transmission/reception antenna 904 described in U.S. Patent Application Publication No. 2012/0119965.

The transmission/reception antenna 904 of FIG. 11 includes a magnetic member 911, a excitation loop antenna 912 disposed on the magnetic member 911, a transmission/reception loop antenna 913 which is disposed close to but not in contact with the excitation loop antenna 912, and a resonance capacitor 914 connected to both ends of the transmission/reception loop antenna 913. The excitation loop antenna 912 includes a loop portion 912*a* with a single turn. The transmission/reception loop antenna includes a loop portion 913*a* with more than one turn. The excitation loop antenna 912 and the transmission/reception loop antenna 913 are attached to the top surface of a base board 921 in such a manner that the excitation loop antenna 912 and the transmission/reception loop antenna 913 are coaxially wound around a columnar portion of the magnetic member 911.

By holding a wireless communication medium, such as an integrated circuit (IC) tag or a non-contact IC card, on the upper portion side of the magnetic member 911, that is, the opposite side of the base board 921, the transmission/reception antenna 904 having this configuration is capable of supplying power to the wireless communication medium and receiving/transmitting a signal from/to the wireless communication medium, achieving broadband frequency characteristics without increasing the power consumption.

However, when the coil antenna having a loop portion wound around the magnetic member, as described in U.S. Patent Application Publication No. 2012/0119965, is applied to a transmission/reception antenna in a push-button switch for engine start which is used in an immobilizer system in a vehicle, there arises the following problem.

In the case of a push-button switch for an immobilizer system, a switching mechanism having switching contacts and driving members is disposed on the top surface of the wiring board to which the portable device which is a wireless communication medium comes close. In addition, such a coil antenna needs a relatively wide area for attachment. As a result, on the top surface of the wiring board, there remains only an extremely small area for attaching the coil antenna having a coil conductor wound around the magnetic core. Therefore, the coil antenna has to be attached to the bottom surface of the wiring board. However, when the coil antenna is attached on the bottom surface of the wiring board, the distance from the portable device is long, and communication with the portable device may fail to be performed.

These and other drawbacks exist.

SUMMARY OF THE DISCLOSURE

Embodiments of the present disclosure are made in view of this technical background, and provide a push-button switch which is capable of communicating with a portable device even when a coil antenna having a coil conductor wound around a magnetic core is attached to the bottom surface of a wiring board.

According to an example embodiment of the present disclosure, a push-button switch includes a wiring board having a first surface on which electronic components are mounted. The push-button switch is used for an immobilizer system and supplies power to a portable device from the first surface side of the wiring board. The push-button switch includes a coil antenna and a conductor pattern. The coil antenna includes a magnetic core and a coil conductor wound around the magnetic core. The coil antenna is attached to a second surface of the wiring board. The conductor pattern is formed in at least one wiring layer so as to surround the coil conductor in plan view. The wiring board has an inner layer including the at least one wiring layer. The coil conductor is connected to the conductor pattern. A direction of current flowing through the coil conductor is the same as a direction of current flowing through the conductor pattern.

In the push-button switch having this configuration, the direction of the current flowing through the coil conductor is the same as that through the conductor pattern. Therefore, the antenna radiation direction for the coil antenna is the same as that for the conductor pattern, and the conductor pattern formed in the inner layer of the wiring board as well as the coil conductor of the coil antenna constitutes a transmission/reception antenna for an immobilizer system. As a result, a longer communication distance between the portable device and the main body of the push-button switch is achieved, enabling communication with the portable device to be performed even when a coil antenna having the coil conductor wound around the magnetic core is attached to the bottom surface of the wiring board.

In the above-described configuration, the conductor pattern may be formed along an outer edge of the wiring board. The coil conductor may be inscribed in the conductor pattern in plan view.

In the push-button switch having this configuration, a high-intensity portion of the magnetic field produced by the coil antenna overlaps that produced by the conductor pattern, achieving a long communication distance.

In the above-described configuration, the at least one wiring layer in the inner layer may include multiple wiring layers. The conductor pattern may be formed by using at least a first conductor pattern and a second conductor pattern, and the first conductor pattern and the second conductor pattern may be formed in a spiral shape in two respective wiring layers among the wiring layers. An outermost turn of the first conductor pattern may be connected to the coil conductor, and an innermost turn of the first conductor pattern may be connected to an innermost turn of the second conductor pattern.

In the push-button switch having this configuration, the conductor pattern is constituted by the first conductor pattern and the second conductor pattern, and the outermost turn of the first conductor pattern is connected to the coil conductor. The first conductor pattern and the second conductor pattern are formed in a spiral shape in the two respective wiring layers. The innermost turn of the first conductor pattern is connected to that of the second conductor pattern. Therefore, the direction of the current flowing through the coil conductor is easily made to be the same as that through the conductor pattern.

In the above-described configuration, the electronic components mounted on the first surface of the wiring board may include a light emitting device.

In the push-button switch having this configuration, the light emitting device is mounted on the first surface of the wiring board, and the coil antenna is mounted on the second surface of the wiring board. Therefore, light from the light emitting device may be transmitted to the operation button without the coil antenna hindering the light from passing through.

DETAILED DESCRIPTION OF THE DISCLOSURE

Figure 1:
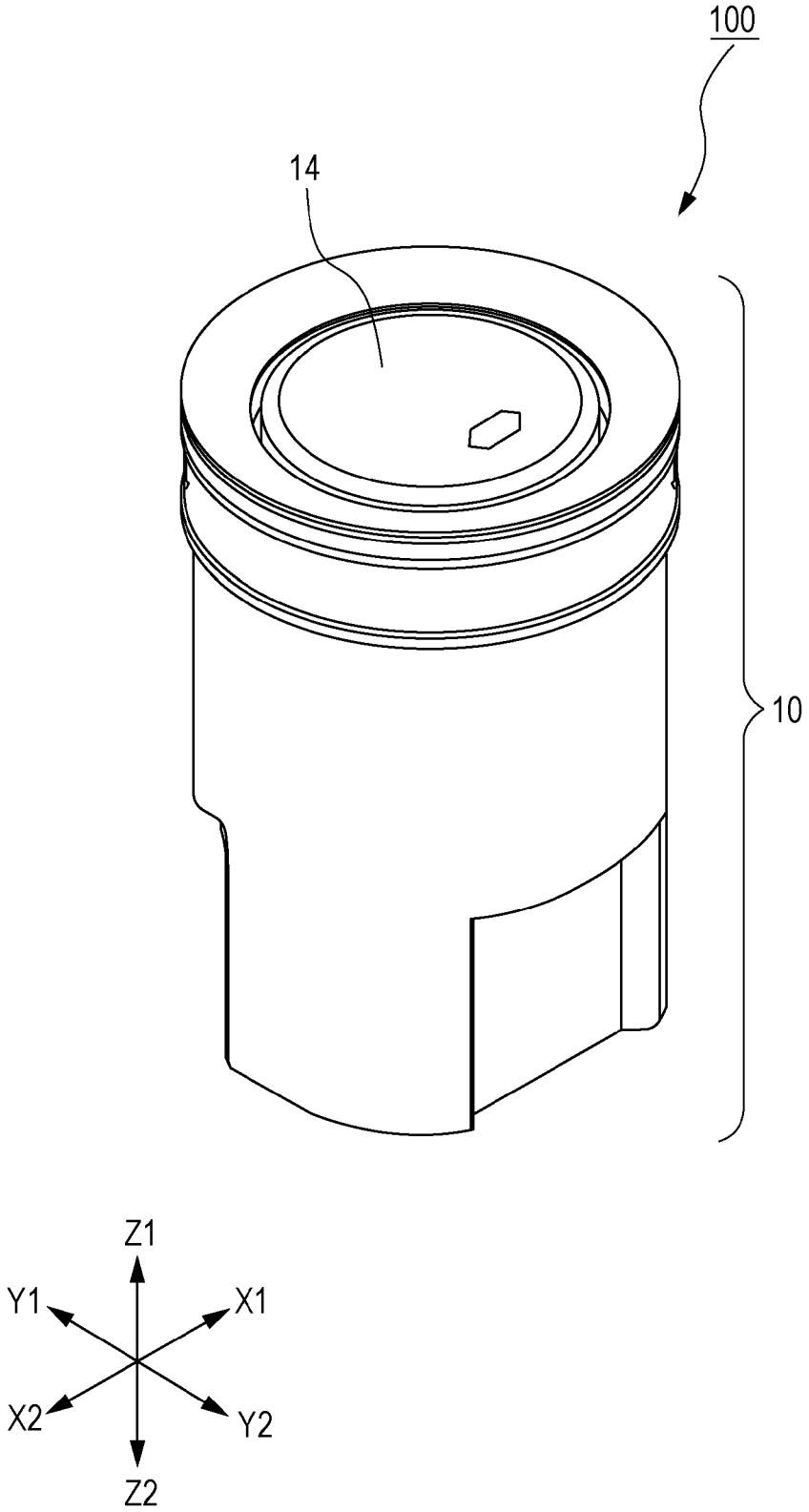
FIG. 1 is a perspective view of an overview of a push-button switch according to an example embodiment of the disclosure.

The following description is intended to convey a thorough understanding of the embodiments described by providing a number of specific embodiments and details involving an push button switch. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

The example embodiments of the present disclosure will be described below with reference to the drawings. Herein, unless otherwise specified, description will be made by using the X1 side in the drawings as the right, using the X2 side as the left, using the Y1 side as the back side, using the Y2 side as the front side, using the Z1 side as the upper side, and using the Z2 side as the lower side.

Figure 2:
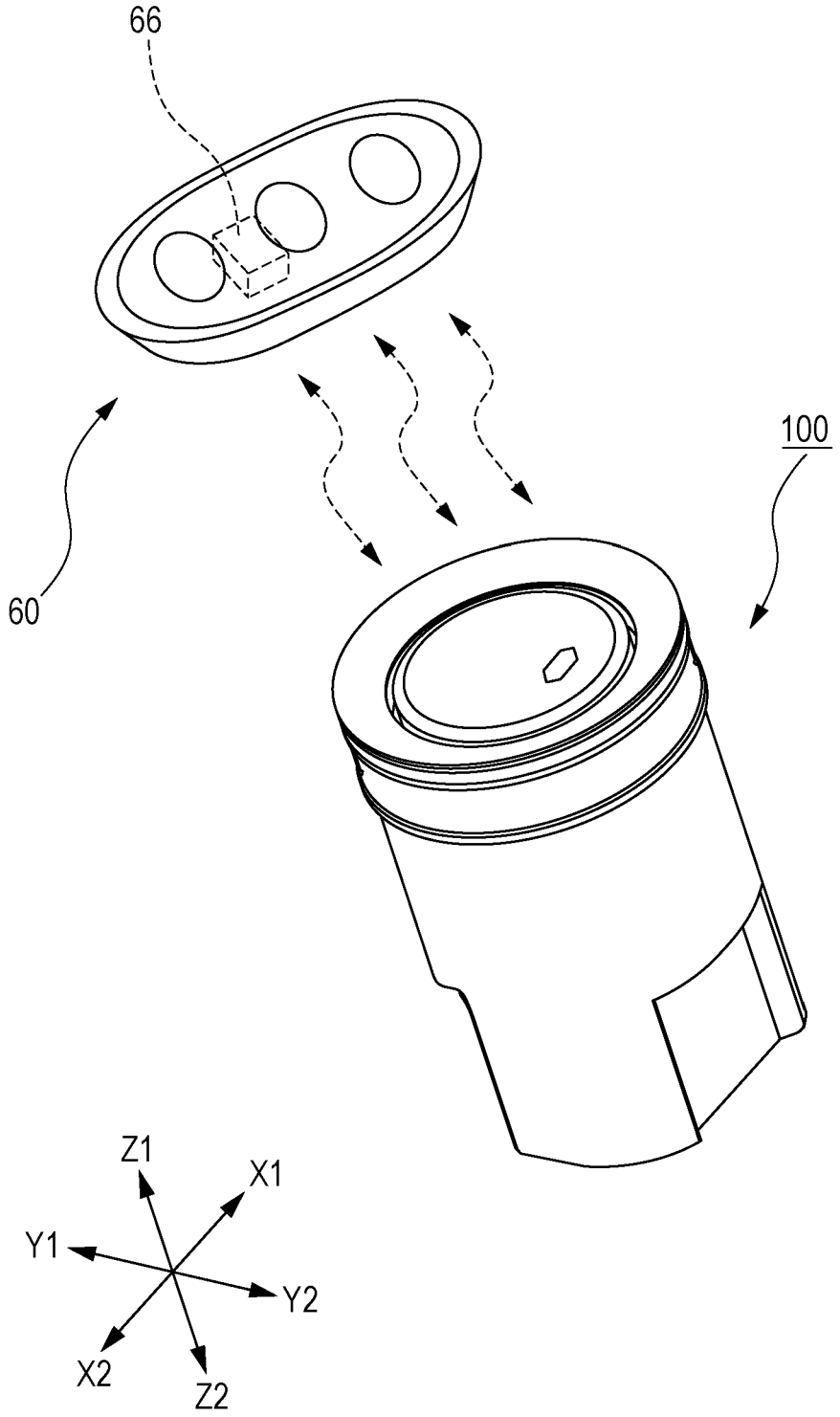
FIG. 2 is a perspective view of a relationship between the push-button switch and a portable device according to an example embodiment of the disclosure.

By using FIGS. 1 and 2, the relationship between a push-button switch 100 and a portable device 60 will be described. FIG. 1 is a perspective view of an overview of the push-button switch 100. FIG. 2 is a perspective view of a relationship between the push-button switch 100 and the portable device 60.

As illustrated in FIG. 1, the push-button switch 100 may include a case 10 and an operation button 14 supported by the case 10, and may have a substantially columnar configuration as a whole.

The push-button switch 100 may be used as a switch for starting a vehicle engine, in an immobilizer system. The top surface of the operation button 14 may be exposed on the front surface of the front panel or the like of a vehicle. A driver presses the exposed operation button 14, for example, toward the lower side (the Z2 side), causing the engine to start. Since the configuration of a system for starting an engine by pressing the operation button 14 is known, its detail will not be described.

Typically, in the immobilizer system, in the case where the battery of a portable device goes dead, or where the voltage of the battery goes down, the portable device fails to perform wireless communication with a vehicle. Accordingly, the engine fails to be started. Therefore, to avoid this situation, a push-button switch for engine start includes a coil antenna functioning as communication means for emergency. The portable device is held close to the push-button switch for engine start, whereby power may be supplied from the coil antenna to the portable device in a non-contact manner, and the communication may be also performed.

The immobilizer system using the push-button switch 100 according an embodiment of the present disclosure is also designed so that, when the voltage of a battery 66 of the portable device 60 illustrated in FIG. 2 becomes equal to or lower than a predetermined voltage, power may be supplied from an antenna in the push-button switch 100 to the portable device 60 in a non-contact manner, and the communication may be also performed.

Figure 3:
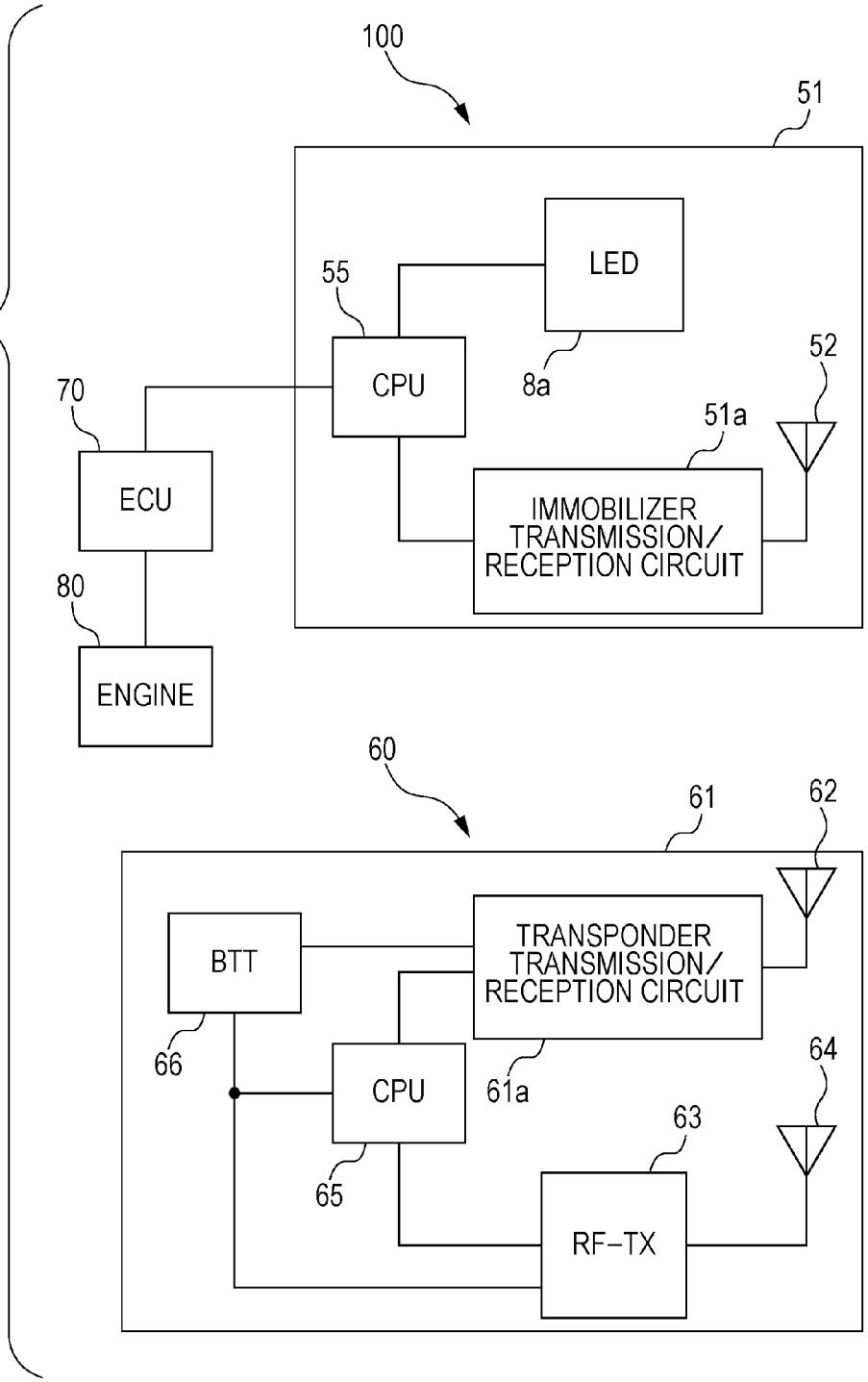
FIG. 3 is a diagram illustrating block configurations of the push-button switch and the portable device according to an example embodiment of the disclosure.

Referring to FIG. 3, block configurations of the push-button switch 100 and the portable device 60 will be described. FIG. 3 includes block diagrams illustrating the push-button switch 100 and the portable device 60.

The push-button switch 100 may include an immobilizer circuit 51 in addition to circuits for switching. The immobilizer circuit 51 may include a transmission/reception antenna 52, an immobilizer transmission/reception circuit 51*a*, a controller circuit 55, and light emitting devices 8*a* such as a light emitting diode (LED).

The immobilizer transmission/reception circuit 51*a* may perform a transmission/reception operation to/from the above-described portable device 60 via the transmission/reception antenna 52. The controller circuit 55 may control the immobilizer transmission/reception circuit 51*a* and the light emitting devices 8*a*. The light emitting devices 8*a* blink when the vehicle engine is to be started, and the blinking is switched to lighting when the vehicle engine is started. The controller circuit 55 may be connected to an engine control unit (ECU) 70, and controls starting and stopping of an engine 80.

The portable device 60 may include a transponder circuit 61. As illustrated in FIG. 3, the transponder circuit 61 may include a transponder transmission/reception circuit 61*a*, a transmission/reception antenna 62, a transmission circuit 63, a transmission antenna 64, a controller circuit 65, and the battery 66.

The transmission circuit 63 and the transmission antenna 64 which are used for a keyless entry system (not illustrated) and which are not used for the immobilizer system will not be described. The transponder transmission/reception circuit 61*a*, the transmission/reception antenna 62, the controller circuit 65, and the battery 66 may be used for both of the immobilizer system and the keyless entry system.

As illustrated in FIG. 3, the battery 66 may supply power to the transponder transmission/reception circuit 61*a*, the controller circuit 65, and the like. The controller circuit 65 controls the transponder transmission/reception circuit 61*a* and the transmission circuit 63. The transponder transmission/reception circuit 61*a* performs a transmission/reception operation to/from the above-described immobilizer transmission/reception circuit 51*a* in cooperation with the transmission/reception antenna 62. When the remaining battery level of the battery 66 becoming zero is detected, the transponder circuit 61 may receive a transmitted signal from the immobilizer circuit 51 by using a near field communication technology, generate a power supply voltage, and perform communication. The near field communication technology which is a known technology will not be described.

Figure 4:
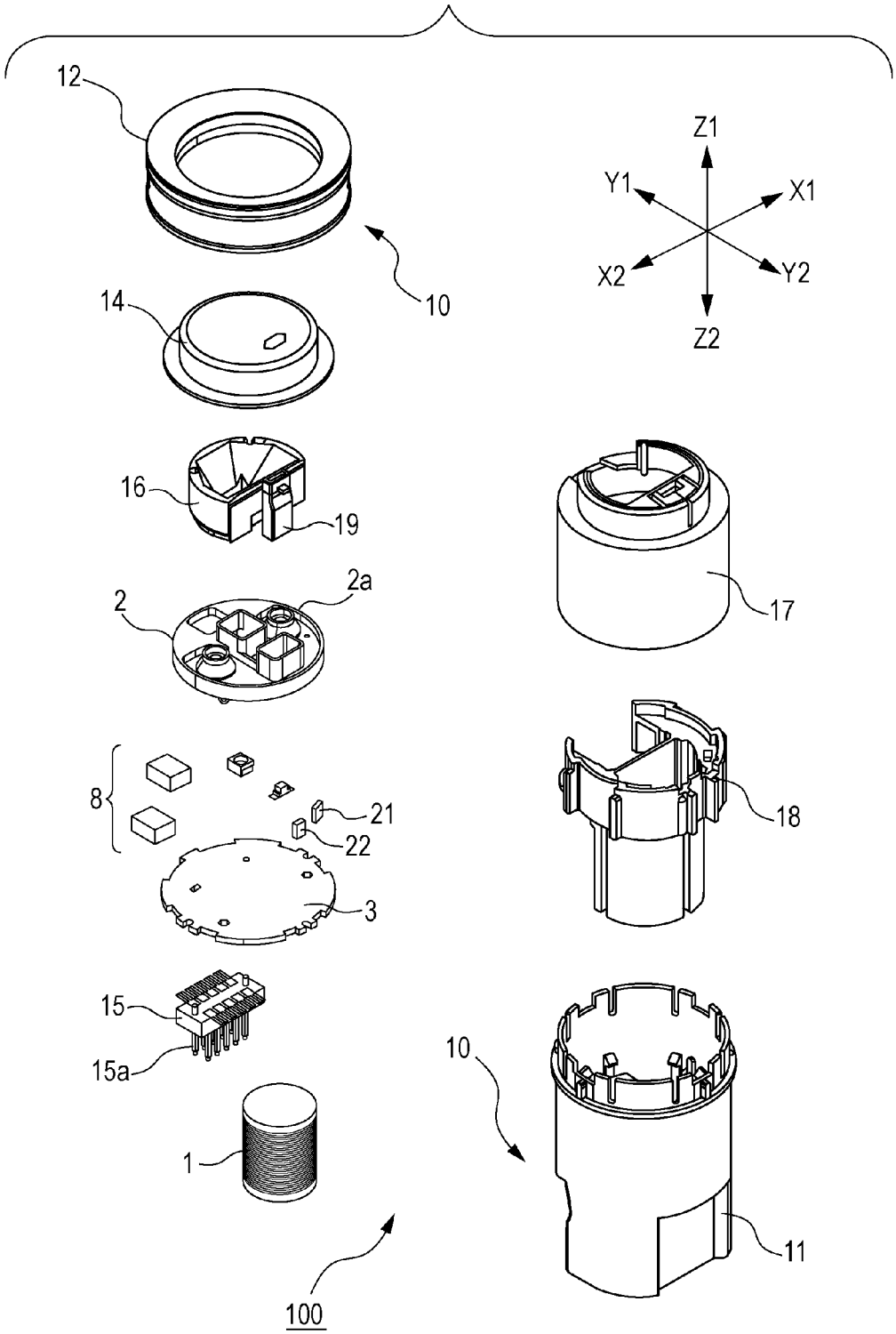
FIG. 4 is an exploded perspective view of the push-button switch according to an example embodiment of the disclosure.

The configuration of the push-button switch 100 will be described by using FIG. 4. As illustrated in FIG. 4, the push-button switch 100 may include the above-described operation button 14, the case 10 including a head cover 12 and a housing 11, a holder 16, an operation button mounting member 17, a driving member 18, a rubber switch 2, and a wiring board 3. A coil antenna 1, electronic components 8, a connector 15, a first terminal 21, and a second terminal 22 may be attached to the wiring board 3. A light guide body 19 may be attached to the holder 16.

The head cover 12 may be attached to an upper portion of the housing 11, and may hold the operation button 14 in such a manner that the operation button 14 is movable in the vertical direction along with the operation button mounting member 17. The housing 11 which may be present in a center portion of the case 10 may have a substantially hollow area.

The driving member 18 which may be attached to the operation button 14 with the operation button mounting member 17 interposed between the driving member 18 and the operation button 14 and which may be movable in the vertical direction in accordance with the movement of the operation button 14 in the vertical direction is housed in the case 10. A switching mechanism may be constituted by the driving member 18, the rubber switch 2 having rubber domes 2*a* which contract and expand in the vertical direction in accordance with the movement of the driving member 18 in the vertical direction, and the wiring board 3 on which the rubber switch 2 is mounted. These members constituting the switching mechanism may be housed in the hollow area in the inner portion of the housing 11, and the wiring board 3 may be attached to the case 10.

The connector 15 may be attached to the wiring board 3. The connector 15 may be provided with multiple connecting terminals 15*a* which are inserted to multiple terminal holes (not illustrated) provided for the housing 11 and which are exposed to the outside. The multiple connecting terminals 15*a* may be connected to the above-described engine control unit 70 or the like.

By using FIGS. 5 to 10, the detailed configuration and operation of the coil antenna 1, the rubber switch 2, and the wiring board 3 which are included in a the push-button switch 100 will be described.

Figure 5:
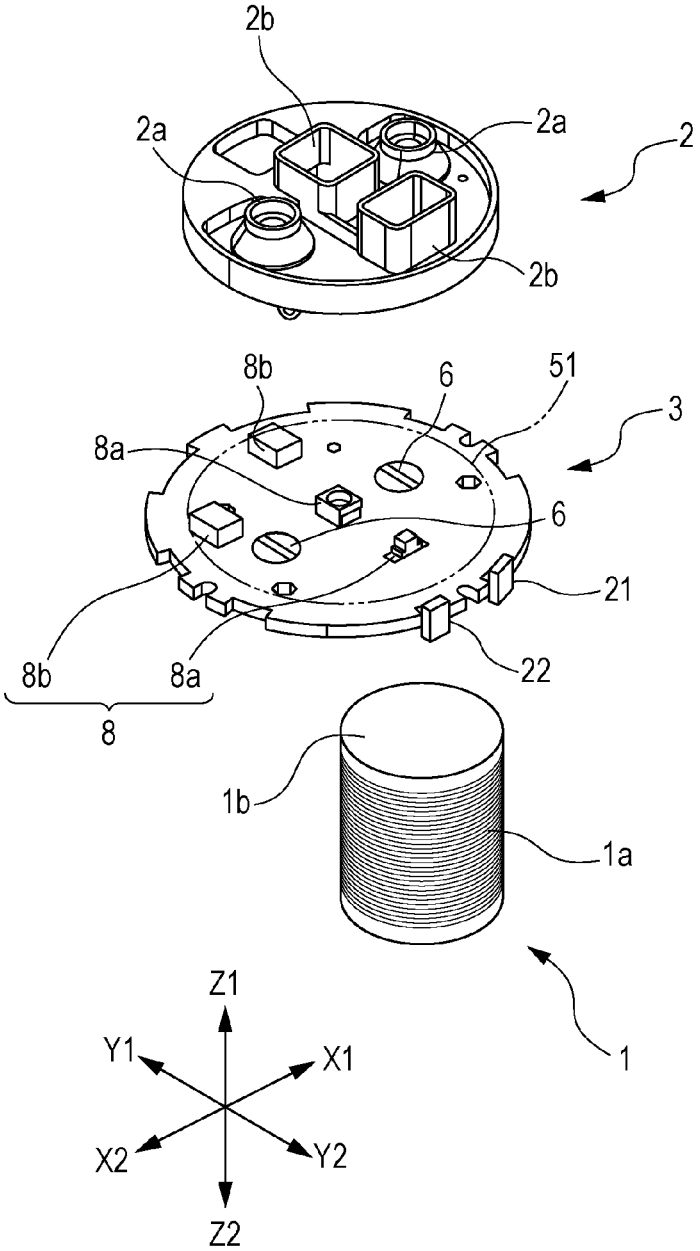
FIG. 5 is an exploded perspective view of a principal part of the push-button switch according to an example embodiment of the disclosure.
Figure 6:
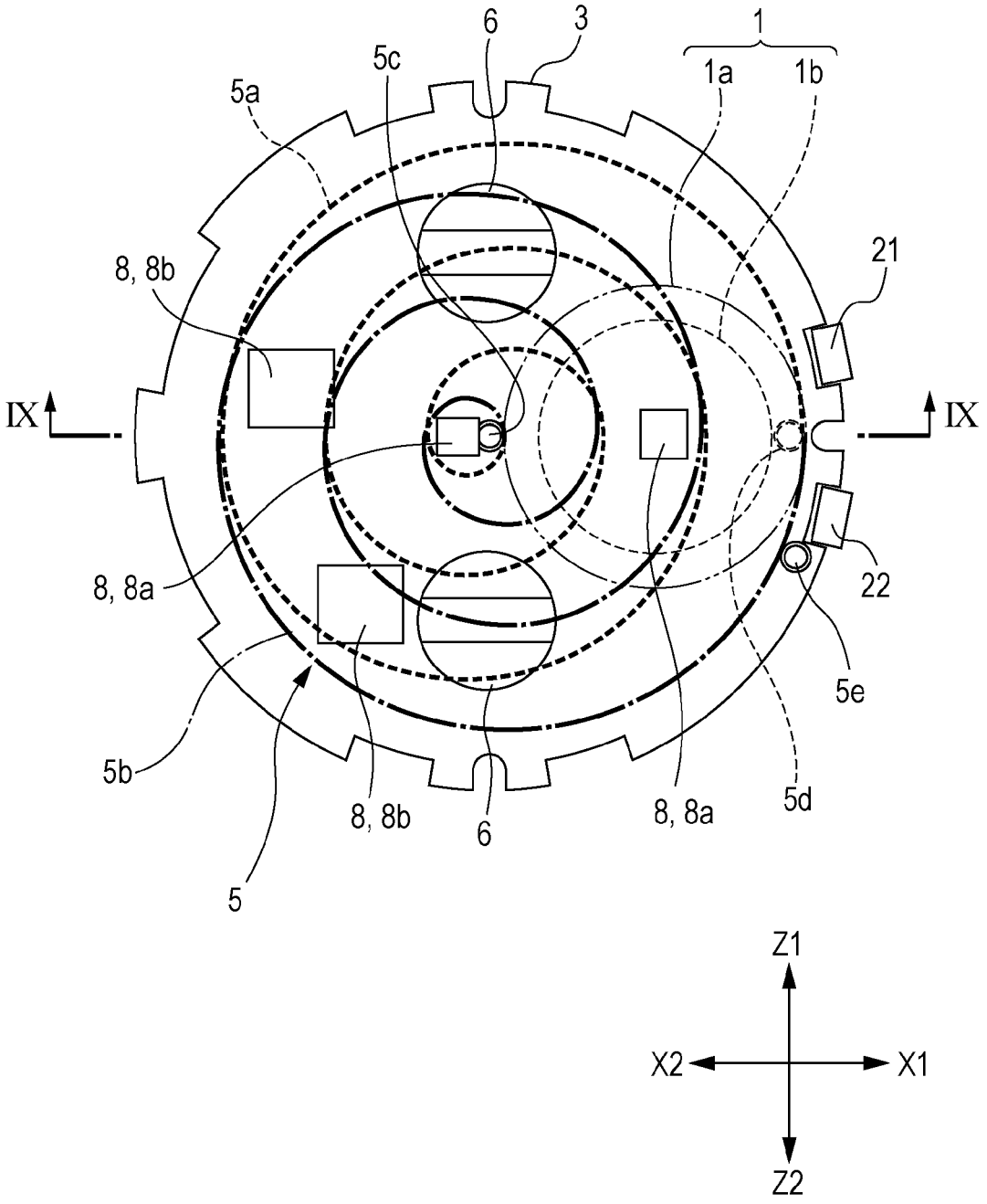
FIG. 6 is a plan view obtained when a wiring board and a coil antenna are viewed from above according to an example embodiment of the disclosure.
Figure 7:
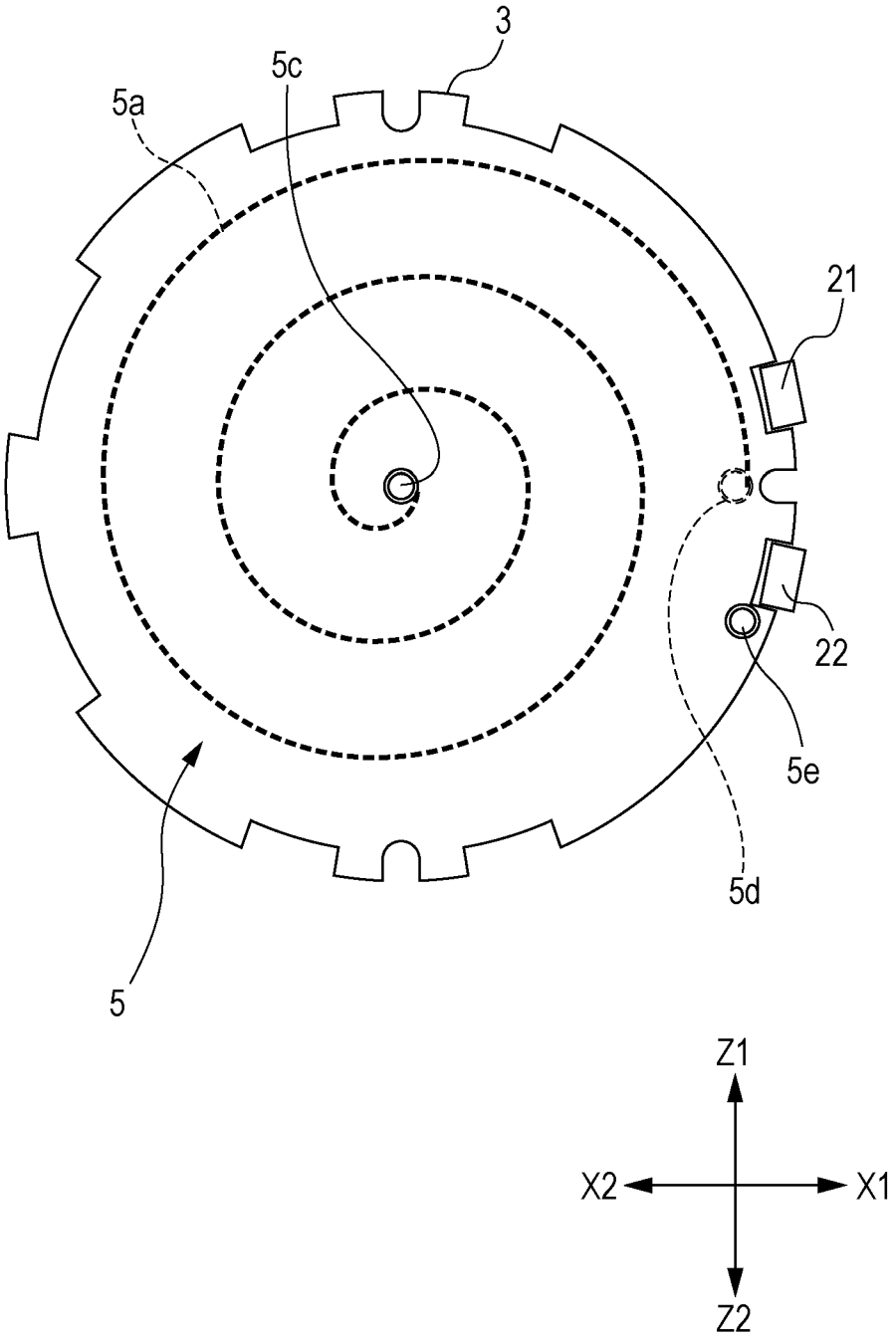
FIG. 7 is a plan view obtained when a first conductor pattern in the wiring board is viewed from above according to an example embodiment of the disclosure.
Figure 8:
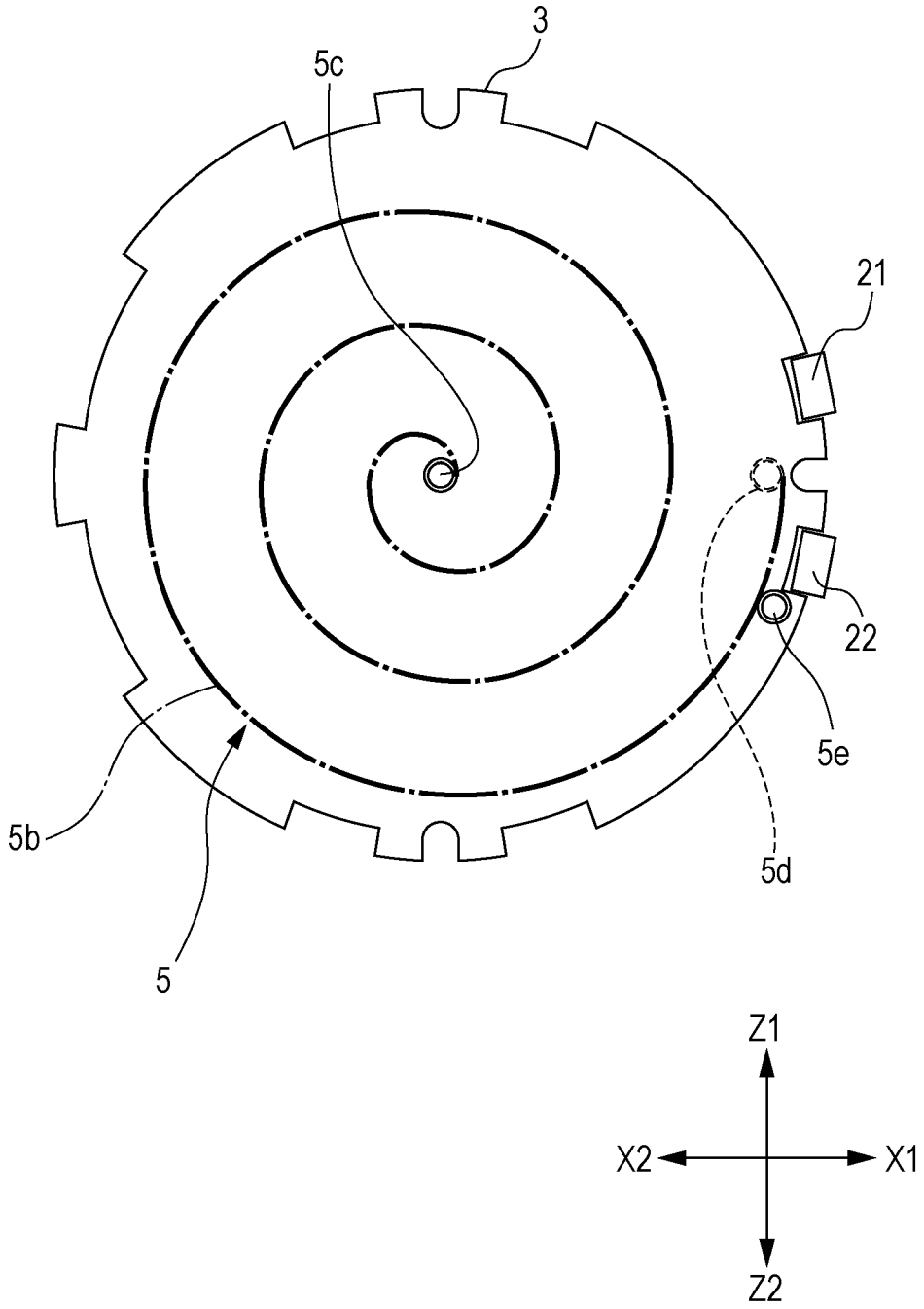
FIG. 8 is a plan view obtained when a second conductor pattern in the wiring board is viewed from above.
Figure 9:
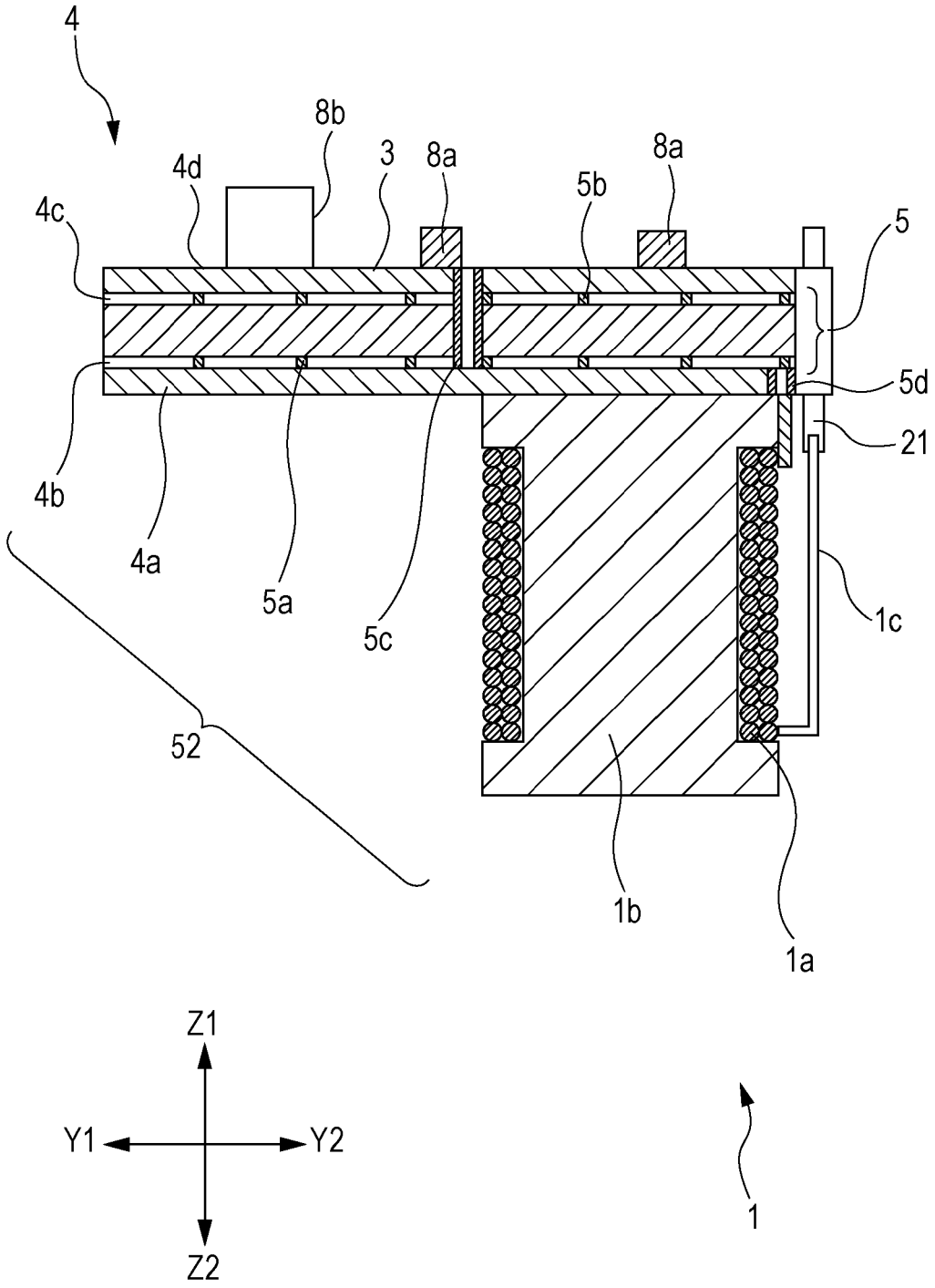
FIG. 9 is a section view along the line IX-IX in FIG. 6, in which the wiring board and the coil antenna are viewed in a lateral direction.
Figure 10:
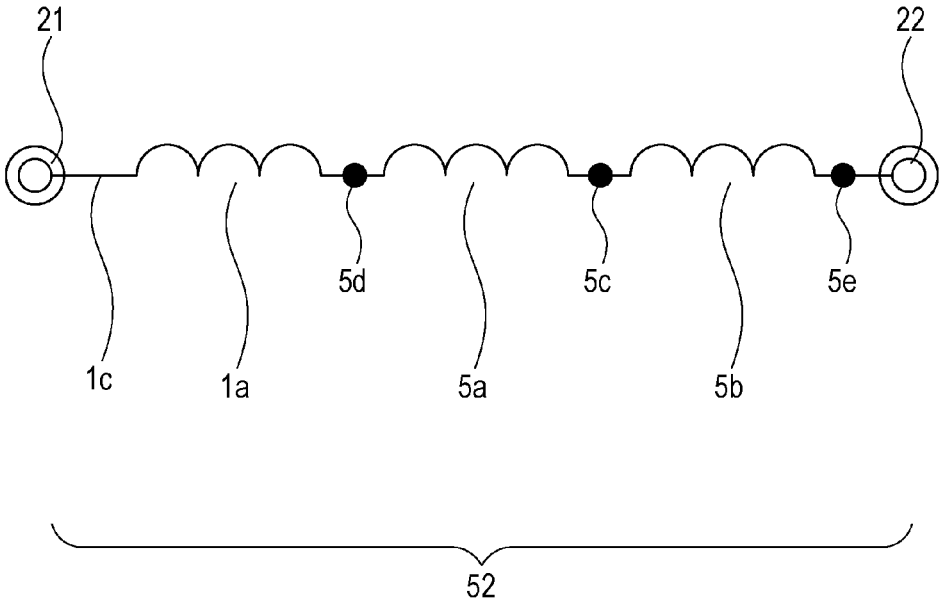
FIG. 10 is a circuit diagram illustrating the connection relationship among a coil conductor and the conductor patterns according to an example embodiment of the disclosure.
Figure 11:
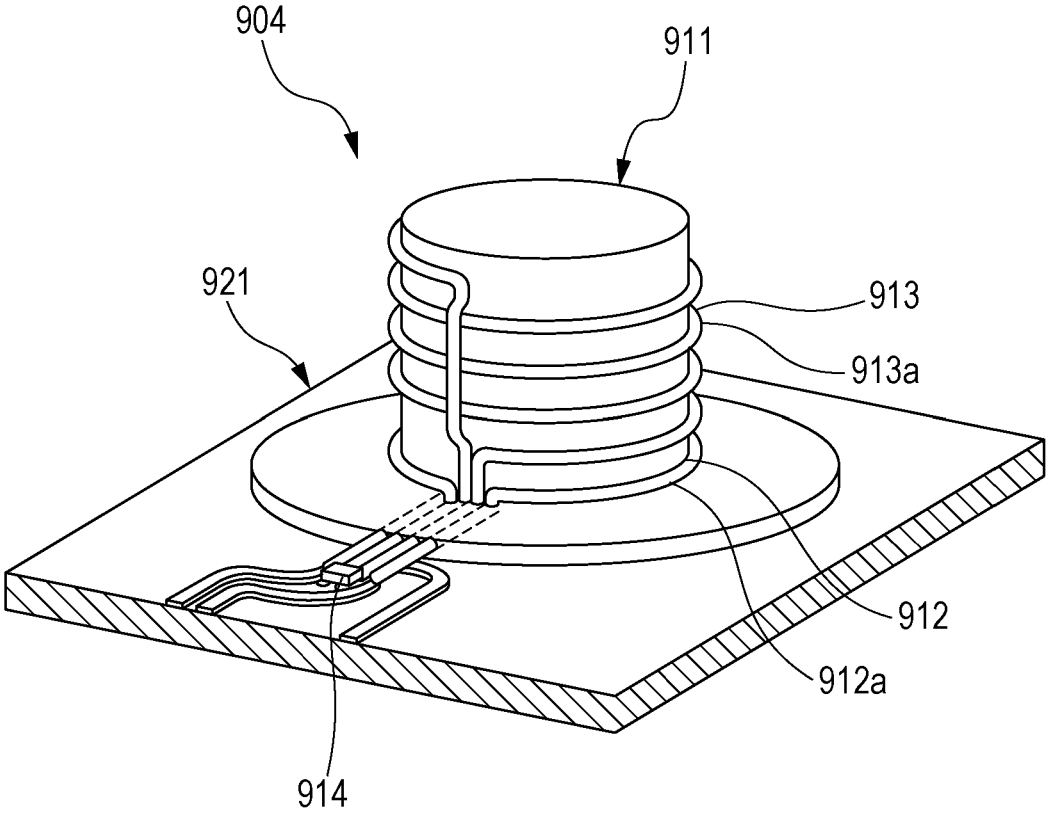
FIG. 11 RELATED ART
FIG. 11 is a perspective view of an exemplary transmission/reception antenna of the related art.

FIG. 5 is an exploded perspective view of the principal part of the push-button switch 100. FIG. 6 is a plan view obtained when the wiring board 3 and the coil antenna 1 are viewed from above by excluding the rubber switch 2. FIG. 7 is a plan view obtained when a first conductor pattern 5*a* in the wiring board 3 is viewed from above. FIG. 8 is a plan view obtained when a second conductor pattern 5*b* in the wiring board 3 is viewed from above. FIG. 9 is a section view along the line IX-IX in FIG. 6, in which the wiring board 3 and the coil antenna 1 are view in a lateral direction. FIG. 10 is a circuit diagram illustrating the connection relationship among a coil conductor 1*a*, the first conductor pattern 5*a*, and the second conductor pattern 5*b*.

As illustrated in FIG. 5, on a first surface (top surface) of the wiring board 3, the rubber switch 2 having the rubber domes 2*a* may be mounted, and the electronic components 8 including the multiple light emitting devices 8*a* (for example, LEDs) and multiple other electronic components 8*b* (for example, integrated circuits) are mounted. The light emitting devices 8*a* and the other electronic components 8*b* constitute the immobilizer circuit 51 along with a wiring pattern (not illustrated) formed on the wiring board 3. The other electronic components 8*b* may be disposed on a second surface (bottom surface) of the wiring board 3 as well as the top surface of the wiring board 3.

As illustrated in FIG. 5, the two rubber domes 2*a* may be disposed on the left and the right in such a manner that the center portion of the substantially circular rubber switch 2 is interposed between the two rubber domes 2*a*. The rubber domes 2*a* formed of an elastic material contract and expand in accordance with a press applied from above. Two fixed contacts 6 formed of copper foil or the like may be formed on the surface of the wiring board 3 on which the rubber domes 2*a* are disposed. The two fixed contacts 6 may be constituted by a pair of conductors, one of which may be connected to the other by using another conductor, entering a conductive state. A traveling contact (not illustrated) which is constituted by a conductor may be disposed on the bottom surfaces of the rubber domes 2*a*. In the push-button switch 100, in response to contraction and expansion of the rubber domes 2*a*, the pair of conductors may come into and out of contact with each other through the traveling contact disposed on the bottom surfaces of the rubber domes 2*a*, whereby the switch is turned on or off.

The rubber switch 2 may be attached so as to cover the entire top surface of the wiring board 3. As illustrated in FIG. 5, the rubber switch 2 may cover the light emitting devices 8*a* and the other electronic components 8*b* which may be disposed on the wiring board 3, enabling these components to be protected. As illustrated in FIG. 5, portions (translucent portions 2*b*) of the rubber switch 2 which cover the light emitting devices 8*a* may have a thickness much thinner than that of the other portions so that light emitted from the light emitting devices 8*a* may be transmitted upward. The light emitted from the light emitting devices 8*a* may be guided upward through the light guide body 19 illustrated in FIG. 4, and the operation button 14 may be irradiated with the light. Accordingly, a driver of the vehicle may recognize the light.

As illustrated in FIG. 5, the coil antenna 1 may be constituted by a magnetic core 1*b* composed of a ferromagnetic material such as ferrite, and the coil conductor 1*a* which may be wound around the magnetic core 1*b*. The coil conductor 1*a* is wound with a predetermined number of turns around the magnetic core 1*b*, whereby a desired inductance value may be obtained. As illustrated in FIG. 9, the coil antenna 1 may be attached to the second surface (bottom surface) of the wiring board 3, not on the first surface of the wiring board 3 on which the light emitting devices 8*a* are mounted.

The reason why the coil antenna 1 is attached to the second surface (bottom surface) of the wiring board 3 is as follows. In the case of the push-button switch 100, on the first surface of the wiring board 3, that is, the surface to which the portable device 60 to be supplied with power comes close, the two fixed contacts 6 are provided, and the rubber switch 2 illustrated in FIG. 5 is mounted. Above the rubber switch 2, the driving member 18 (see FIG. 4) for achieving a switching mechanism by cooperating with the wiring board 3 and the rubber switch 2 is disposed. The light emitting devices 8*a* such as LEDs and the other electronic components 8*b* are attached to the first surface of the wiring board 3. Accordingly, a space which extends upwardly from the light emitting devices 8*a* to the operation button 14 (see FIG. 4) is required to transmit light. In addition, the coil antenna 1 requires a relatively wide area for attachment. Therefore, there is no room for attaching the coil antenna 1 to the surface (top surface) of the wiring board 3 to which the portable device 60 to be supplied with power comes close. Consequently, in the push-button switch 100 for an immobilizer circuit, the coil antenna 1 has to be attached to the second surface (bottom surface) of the wiring board 3.

As illustrated in FIG. 9, the wiring board 3 may include multiple wiring layers 4 in which a conductor pattern 5 may be formed. As the multiple wiring layers 4, there may be a first wiring layer 4*a* on the second surface (bottom surface) of the wiring board 3, a fourth wiring layer 4*d* on the first surface (top surface) of the wiring board 3, and other wiring layers 4 in an inner layer of the wiring board 3. There may be a second wiring layer 4*b* as a wiring layer just above the first wiring layer 4*a*, and a third wiring layer 4*c* as a wiring layer just below the fourth wiring layer 4*d*. That is, the first conductor pattern 5*a* may be formed in the second wiring layer 4*b* in the inner layer of the wiring board 3, and the second conductor pattern 5*b* may be formed in the third wiring layer 4*c*, whereby the first conductor pattern 5*a* and the second conductor pattern 5*b* constitute the conductor pattern 5.

As illustrated in FIG. 6, the conductor pattern 5 may be formed along the outer edge of the wiring board 3, and may be formed so as to surround the coil conductor 1*a* of the coil antenna 1 in plan view. The conductor pattern 5 also may be formed so that the coil conductor 1*a* is inscribed in the conductor pattern 5 in plan view. As illustrated in FIGS. 6 to 9, the first conductor pattern 5*a* and the second conductor pattern 5*b* of the conductor pattern 5 may be formed in a spiral shape in the second wiring layer 4*b* and the third wiring layer 4*c*, respectively. The outermost turn of the first conductor pattern 5*a* may be connected to the coil conductor 1*a*, and the innermost turn of the first conductor pattern 5*a* may be connected to that of the second conductor pattern 5*b*.

As illustrated in FIGS. 6 to 9, the innermost turn of the first conductor pattern 5*a* may be connected to that of the second conductor pattern 5*b* approximately at the center of the wiring board 3 through a first through hole 5*c*. That is, the first through hole 5*c* located approximately at the center of the wiring board 3 may cause the innermost turn of the first conductor pattern 5*a* in the second wiring layer 4*b* of the wiring board 3 to be connected to that of the second conductor pattern 5*b* in the third wiring layer 4*c*.

As illustrated in FIGS. 6 to 9, the outermost turn of the first conductor pattern 5*a* may be connected to the coil conductor 1*a* near the end portion, which is present approximately on the right, of the wiring board 3. The end portion of the outermost turn of the first conductor pattern 5*a* is led out from the second wiring layer 4*b* of the wiring board 3 to the first wiring layer 4*a* by using a second through hole 5*d*, and may be connected to a first end portion of the coil conductor 1*a* by using solder or the like in the first wiring layer 4*a*. These connections among the coil conductor 1*a*, the first conductor pattern 5*a*, and the second conductor pattern 5*b* constitute the transmission/reception antenna 52 illustrated in FIG. 3.

In the transmission/reception antenna 52 having this configuration, the winding direction of the coil conductor 1*a* in the coil antenna 1 may be the same as that of the first conductor pattern 5*a* and the second conductor pattern 5*b*. For example, when the winding direction of the coil conductor 1*a* is set to the left winding direction in plan view from above, as illustrated by using the dashed line in FIG. 6, the first conductor pattern 5*a* in the second wiring layer 4*b* may be formed in a spiral shape by starting forming the first conductor pattern 5*a* in the left winding direction from the second through hole 5*d* located in the periphery of the wiring board 3 and by winding the first conductor pattern 5*a* with three turns in the second wiring layer 4*b* so that the first conductor pattern 5*a* reaches the first through hole 5*c* located in the center portion of the wiring board 3. Then, as illustrated by using the long dashed short dashed line in FIG. 6, the second conductor pattern 5*b* in the third wiring layer 4*c* may be formed in a spiral shape by starting forming the second conductor pattern 5*b* in the left winding direction from the first through hole 5*c* located in the center portion of the wiring board 3 and by winding the second conductor pattern 5*b* with three turns in the third wiring layer 4*c* so that the second conductor pattern 5*b* reaches the third through hole 5*e* located in the periphery of the wiring board 3.

Each of the first conductor pattern 5*a* and the second conductor pattern 5*b* may be formed as described above, whereby the winding direction of the entire conductor pattern 5 constituted by the first conductor pattern 5*a* and the second conductor pattern 5*b* is naturally set to the left winding direction in plan view, which is the same as that of the coil conductor 1*a*. Therefore, the direction of current flowing through the coil conductor 1*a* may be the same as that through the conductor pattern 5. In other words, the first conductor pattern 5*a* and the second conductor pattern 5*b* may be formed as illustrated in FIGS. 6 to 9 so that the direction of current flowing through the coil conductor 1*a* is the same as that through the conductor pattern 5. This configuration enables the antenna radiation direction for the coil antenna 1 to be the same as that for the conductor pattern 5. That is, the coil antenna 1 and the conductor pattern 5 constitute one transmission/reception antenna 52.

As illustrated in FIGS. 5 to 9, the first terminal 21 and the second terminal 22 for connecting the immobilizer transmission/reception circuit 51*a* to the transmission/reception antenna 52 illustrated in FIG. 3 may be attached to the wiring board 3. As illustrated in FIG. 9, the first terminal 21 may be connected to a connecting conductor 1*c* which is a second end portion of the coil conductor 1*a* by using solder or the like. The second terminal 22 may be connected to the end portion of the outermost turn of the second conductor pattern 5*b* by using solder or the like. As illustrated in FIGS. 6 to 9, the end portion of the outermost turn of the second conductor pattern 5*b* may be led out from the third wiring layer 4*c* of the wiring board 3 to the fourth wiring layer 4*d* by using a third through hole 5*e*, and is connected to the second terminal 22 in the fourth wiring layer 4*d* by using solder or the like.

FIG. 10 is a circuit diagram illustrating the state in which the transmission/reception antenna 52 is formed by connecting the coil conductor 1*a*, the first conductor pattern 5*a*, and the second conductor pattern 5*b* to one another from the first terminal 21 to the second terminal 22. The end portion of the innermost turn of the first conductor pattern 5*a* may be connected to that of the second conductor pattern 5*b* by using the first through hole 5*c*, and the end portion of the outermost turn of the first conductor pattern 5*a* is connected to the first end portion of the coil conductor 1*a* by using the second through hole 5*d*. The connecting conductor 1*c* which is the second end portion of the coil conductor 1*a* may be connected to the first terminal 21, and the end portion of the outermost turn of the second conductor pattern 5*b* may be connected to the second terminal 22 by using the third through hole 5*e*. The transmission/reception antenna 52 obtained by connecting the coil conductor 1*a*, the first conductor pattern 5*a*, and the second conductor pattern 5*b* may be connected to the immobilizer transmission/reception circuit 51*a* illustrated in FIG. 3 on the wiring board 3, enabling the transmission/reception antenna 52 to be used as one for the immobilizer circuit 51.

Thus, in the push-button switch 100, the direction of current flowing through the coil conductor 1*a* may be the same as that through the conductor pattern 5. Thus, the antenna radiation direction for the coil antenna 1 may be the same as that for the conductor pattern 5, enabling the conductor pattern 5 formed in the inner layer of the wiring board 3 as well as the coil conductor 1*a* of the coil antenna 1 to constitute the transmission/reception antenna 52 for an immobilizer system. As a result, a longer communication distance between the portable device 60 and the main body of the push-button switch 100 may be achieved, enabling communication with the portable device 60 to be performed even in the case where the coil antenna 1 having the coil conductor 1*a* wound around the magnetic core 1*b* is attached to the bottom surface of the wiring board 3.

In the push-button switch 100, the conductor pattern 5 may be formed along the outer edge of the wiring board 3, and the coil conductor 1*a* is inscribed in the conductor pattern 5 in plan view. Therefore, a high-intensity portion of the magnetic field produced by the coil antenna 1 overlaps that produced by the conductor pattern 5, achieving a long communication distance.

In the push-button switch 100, the conductor pattern 5 may be constituted by the first conductor pattern 5*a* and the second conductor pattern 5*b*, and the outermost turn of the first conductor pattern 5*a* is connected to the coil conductor. The first conductor pattern 5*a* and the second conductor pattern 5*b* are formed in a spiral shape in the second wiring layer 4*b* and the third wiring layer 4*c*, respectively. The innermost turn of the first conductor pattern 5*a* may be connected to that of the second conductor pattern 5*b*. Therefore, the direction of current flowing through the coil conductor 1*a* is easily made to be the same as that through the conductor pattern 5.

In the push-button switch 100, the light emitting devices 8*a* may be mounted on the first surface of the wiring board 3, and the coil antenna 1 is mounted on the second surface of the wiring board 3. Therefore, light from the light emitting devices 8*a* may be transmitted to the operation button 14 without the coil antenna 1 hindering light from passing through.

As described above, in the push-button switch according to the embodiments of the present disclosure, the direction of current flowing through the coil conductor is the same as that through the conductor pattern. Therefore, the antenna radiation direction for the coil antenna may be the same as that for the conductor pattern. The conductor pattern formed in the inner layer of the wiring board as well as the coil conductor of the coil antenna may function as the transmission/reception antenna for an immobilizer system. As a result, a longer communication distance between the portable device and the main body of the push-button switch is achieved, enabling communication with the portable device to be performed even in the case where the coil antenna having the coil conductor wound around the magnetic core is attached to the bottom surface of the wiring board.

The present invention is not limited to the description about the embodiments, and changes may be made as appropriate to obtain an aspect in which the effect is achieved, and may be embodied. For example, in the push-button switch 100, the coil antenna 1 has a columnar shape. The coil antenna 1 may have a square column shape.

The embodiments of the present inventions are not to be limited in scope by the specific embodiments described herein. Further, although some of the embodiments of the present disclosure have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A push-button switch including a wiring board having a first surface on which electronic components are mounted, the push-button switch being used for an immobilizer system and supplying power to a portable device from the first surface side of the wiring board, the push-button switch comprising:

a coil antenna including a magnetic core and a coil conductor wound around the magnetic core, the coil antenna being attached to a second surface of the wiring board; and a conductor pattern formed in at least one wiring layer so as to surround the coil conductor in plan view, the wiring board having an inner layer including the at least one wiring layer, wherein the coil conductor is connected to the conductor pattern, and wherein a direction of current flowing through the coil conductor is the same as a direction of current flowing through the conductor pattern.

2. The push-button switch according to claim 1, wherein the conductor pattern is formed along an outer edge of the wiring board, and wherein the coil conductor is inscribed in the conductor pattern in plan view.

3. The push-button switch according to claim 2, wherein the at least one wiring layer in the inner layer includes a plurality of wiring layers, wherein the conductor pattern is formed by using at least a first conductor pattern and a second conductor pattern, and the first conductor pattern and the second conductor pattern are formed in a spiral shape in two respective wiring layers among the plurality of wiring layers, and wherein an outermost turn of the first conductor pattern is connected to the coil conductor, and an innermost turn of the first conductor pattern is connected to an innermost turn of the second conductor pattern.

4. The push-button switch according to claim 1, wherein the electronic components mounted on the first surface of the wiring board include a light emitting device.

* * * * *